United States Patent [19]

Suzuki

[11] 4,198,937

[45] Apr. 22, 1980

[54] PNEUMATIC CONTROL APPARATUS FOR INTERNAL COMBUSTION

[75] Inventor: Motoo Suzuki, Kyoto, Japan

[73] Assignee: Mitsubishi Jidosha Kogyo Kabushiki Kaisha, Tokyo, Japan

[21] Appl. No.: 32,425

[22] Filed: Apr. 23, 1979

Related U.S. Application Data

[63] Continuation of Ser. No. 802,155, May 31, 1977, abandoned.

[51] Int. Cl.[2] ..... F02P 5/02

[52] U.S. Cl. ..... 123/117 A; 137/627.5

[58] Field of Search ..... 123/117 A; 60/290; 137/627.5

[56] References Cited

U.S. PATENT DOCUMENTS

| | | | |
|---|---|---|---|
| 2,091,924 | 8/1937 | Harmon | 123/117 A |
| 2,249,446 | 7/1941 | Vanderpool et al. | 123/117 A |
| 2,827,889 | 5/1958 | Smithey | 123/117 A |
| 3,476,094 | 11/1969 | Rucins et al. | 123/117 A |
| 3,478,729 | 11/1969 | Iada | 123/117 A |
| 3,487,819 | 1/1970 | Wiyazaki et al. | 123/117 A |
| 3,521,609 | 7/1970 | Kashiwagi et al. | 123/117 A |
| 3,650,253 | 3/1972 | Cooksey | 123/117 A |
| 3,804,109 | 4/1974 | Martin et al. | 123/117 A |
| 4,030,460 | 6/1977 | Tanaka et al. | 123/117 A |
| 4,050,423 | 9/1977 | Inada et al. | 123/117 A |

*Primary Examiner*—Ronald H. Lazarus
*Assistant Examiner*—R. A. Nell
*Attorney, Agent, or Firm*—Sughrue, Rothwell, Mion, Zinn and Macpeak

[57] ABSTRACT

A pneumatic control apparatus is disclosed for an engine exhaust emission control device which includes a passage 101 for applying a negative intake passage pressure to a chamber of a differential pressure responsive unit 10 an atmospheric venting vacuum control valve 30 is provided for selectively venting the passage 101. The negative pressure chamber 37 of the valve 30 is controlled by an orifice unit 40 which supplies atmospheric pressure and/or negative pressures from spaced positions in the intake passage proximate the throttle valve 2 via flow restrictors 43, 44, whereby suitable response delays are provided. A further restrictor and check valve connected in parallel may also be employed to alter the response time. The proper selection of the restrictor flow resistances and the biasing spring strengths in the various control valves enables a wide range of operational control.

17 Claims, No Drawings

PNEUMATIC CONTROL APPARATUS FOR INTERNAL COMBUSTION

This is a continuation of application Ser. No. 802,155, filed May 31, 1977, now abandoned.

BACKGROUND OF THE INVENTION

The invention relates to a pneumatic control apparatus for an exhaust emission cleaning system of an internal combustion engine, wherein a controlled negative pressure is applied to a differential pressure responsive device, such as a diaphragm or a piston.

Modern internal combustion engines include various ones of an exhaust gas recirculation system, an ignition distributor timing delay system, a secondary air supply system, or a dashpot control system for reducing the generation of harmful exhaust gases such as hydrocarbons (HC), carbon monoxide (CO), and nitrous oxide (NOX).

It is generally desirable that the operation of the exhaust gas recirculating system, the ignition timing delay system, and/or the secondary air supply system be stopped or restricted during continuous high speed, high load, and idling conditions and during the initial engine warmup period, but be fully operable during frequently encountered low speed, low load and acceleration conditions during which large quantities of harmful gases are produced, and that the dashpot control system be operable during high speed conditions and stopped during low speed conditions.

The reason for this is as follows: The operation of the exhaust gas recirculation system or the distributor timing delay system during continuous high speed or high load conditions causes engine output power reduction, fuel consumption increase, and exhaust system overheating, and the operation thereof during continuous idling conditions causes idle stability deterioration, increased fuel consumption, and heat damage due to insufficient engine cooling air. The operation of these systems during engine warmup causes start performance deterioration, increased vibration, and engine instability. On the other hand, the operation of the secondary air supply system during continuous high speed of high load conditions causes overheating which reduces the durability of the various cleaning systems. The operation of the dashpot control system during low speed conditions causes poor engine braking.

To overcome such problems a number of apparatuses for controlling exhaust gas cleaning systems have been proposed, such as an apparatus for controlling the systems with electrical signals increasing the rpms, load, temperature, etc. of the engine which are electrically detected, and another apparatus for pneumatically controlling the systems according to changes in the engine rpms, load, temperature, etc. on the basis of the negative pressure appearing in the intake passage of the engine.

Such apparatuses require complex electrical control circuits which are expensive and unreliable; however, or complicated negative pressure control circuits and an increased number of costly thermosensers, timers, and the like.

SUMMARY OF THE INVENTION

In accordance with a first aspect of the present invention an improved pneumatic control apparatus supplies two different negative pressures appearing in the intake passage of an internal combustion engine to the negative pressure chamber of a vacuum valve through orifices whose flow resistances are suitably selected to control the magnitude of the negative pressure in the chamber and to delay its transmission thereto.

In accordance with a second aspect of the invention atmospheric pressure is also introduced into the negative pressure chamber of the vacuum valve through a flow restriction orifice, the introduction of such atmospheric pressure being controlled by a valve adapted to open and close according to engine running conditions.

In accordance with a third aspect of the invention a negative pressure produced in the engine intake passage is fed to a differential pressure responsive unit via a negative pressure passage having a vacuum control valve unit disposed therein. The negative pressure chamber of the latter is controlled in accordance with the first or second aspects of the invention.

DETAILED DESCRIPTION OF THE PREFERRED EMBODIMENTS

Figure 1:
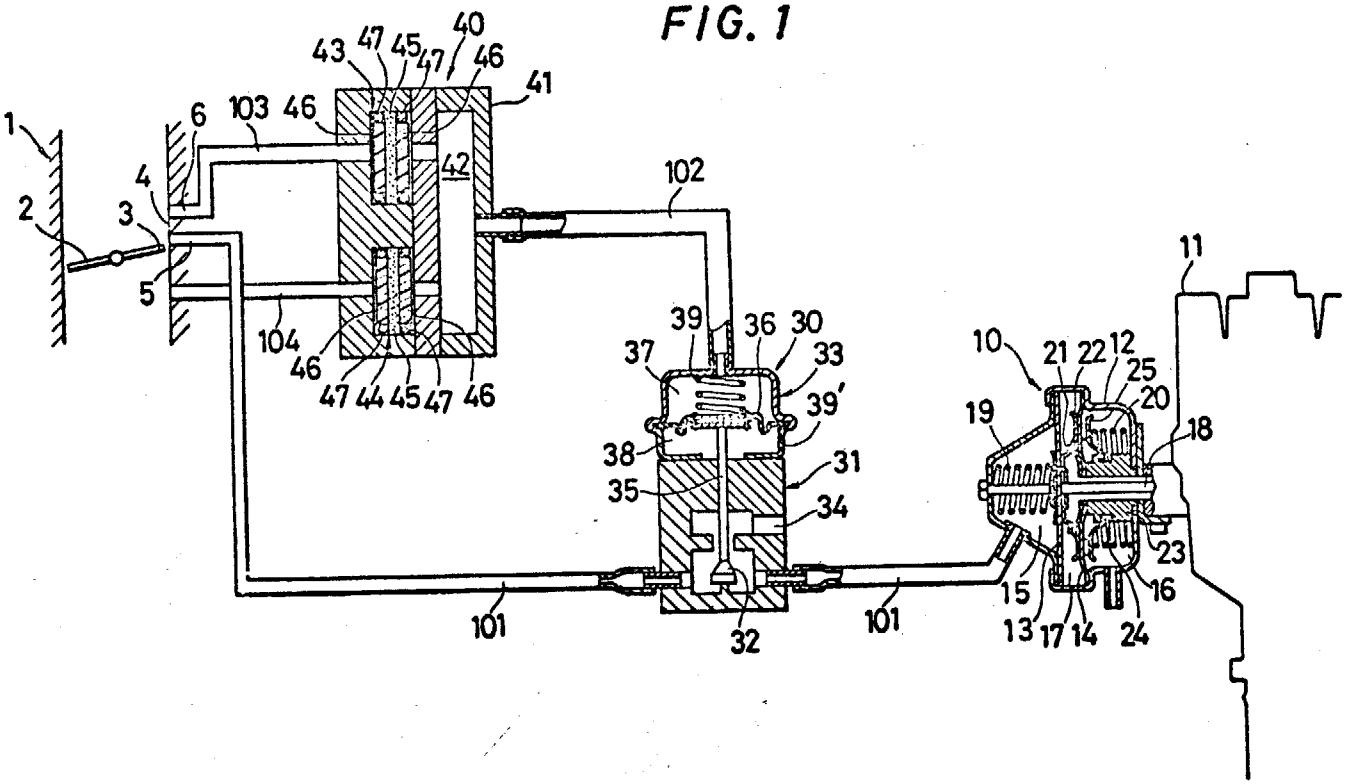
FIG. 1 is a sectional view of a pneumatic control apparatus according to a first embodiment of the present invention.

Referring now to FIG. 1, a pneumatic control apparatus in accordance with a first embodiment of the present invention is applied to an internal combustion engine having a fuel mixture intake passage 1 communicating with cylinder intake ports (not shown) and having a throttle valve 2 coupled to an accelerator pedal (not shown). The pneumatic control apparatus comprises a vacuum advance control unit 10 for the distributor 11, a vacuum valve unit 30, and an orifice unit 40.

The vacuum advance control unit 10 for the distributor 11 in this embodiment is of the dual diaphragm type having an advance diaphragm 13 and a delay diaphragm 14 arranged within a diaphragm housing 12 so as to divide the housing into three chambers; an advance diaphragm chamber 15, a delay diaphragm chamber 16, and a diaphragm chamber 17 sandwiched between the two chambers 15 and 16. The advance chamber 15 communicates through a negative pressure passage 101 with a port 5 formed in the intake passage wall 4 at a position slightly above the fully closed position of the throttle valve and in the vicinity of the free end 3 of the throttle valve on the upstream side. The delay chamber 16 communicates with an intake manifold (not shown), and the intermediate chamber 17 is open to the atmosphere. An ignition timing control rod 18 is centrally fixed to the advance diaphragm 13, and a spring 19 in the advance chamber 15 urges the advance diaphragm 13 toward the chamber 16. Another spring 20 in the chamber 16 urges the diaphragm 14 toward the chamber 15. A stopper 21 is fixed to the advance diaphragm 13 and another stopper 22 is fixed to the delay diaphragm 14 to abut against the stopper 21. A circular cup 25 is fixed to the diaphragm 14 and engages a circular groove 24 in the outer peripheral surface of a circular member 23 projecting into the center of the chamber 16.

When a negative pressure in the manifold or in the intake passage downstream of the throttle valve 2 is introduced into the delay chamber 16, the diaphragm 14 is attracted toward the chamber 16 against the force of the spring 20, and the stopper 22 moves toward the chamber 16, its movement being restricted to a range defined by the width of the circular groove 24. On the other hand, when a negative pressure in the port 5 is introduced into the advance diaphragm chamber 15, the advance diaphragm 13 is attracted toward the chamber 15 against the force of the spring 19 and is held in a balanced position.

Accordingly, when the chamber 15 is at atmospheric or a slight negative pressure the diaphragm 13 is halted with the stopper 21 abutting the stopper 22 whereby the ignition timing is delayed, whereas when the chamber 15 is at a high negative pressure the ignition timing is advanced in accordance with the magnitude of such pressure.

The vacuum valve unit 30 comprises a valve box 31 through which the passage 101 is coupled, a valve 32 for opening and closing an atmospheric pressure release opening 34 in the valve box 31, and a diaphragm 36 dividing the valve box into first and second chambers 37 and 38. The valve 32 is connected through a rod 35 to the center of the diaphragm 36. The first chamber 37 is connected to an air passage 102 and the second chamber 38 is connected to the atmosphere through an opening 39'. A spring 39 within the first chamber 37 urges the diaphragm 36 toward the second chamber 38.

When the first chamber 37 is at atmospheric or a slight negative pressure the diaphragm 36 is held in the lower position by the spring 39 so that the valve 32 is open and the passage 101 is at atmospheric pressure, whereas when the chamber 37 is at a negative pressure above a predetermined level the diaphragm 36 is attracted upwardly against the force of the spring to close the valve 32.

The orifice unit 40 comprises a housing 41, an air chamber 42 communicating through the passage 102 with the first chamber 37 of the control valve unit 30, and a pair of orifices 43 and 44 communicating with the air chamber 42. The other end of orifice 43 communicates through an air passage 103 with a port 6 positioned slightly above the port 5, and the other end of orifice 44 communicates through an air passage 104 with the intake passage 1 just below the free end of the throttle valve on the downstream side.

Each of the orifices 43 and 44 comprises a porous sintered metal disc 45, a pair of disc-shaped filters 46 provided on the opposite surfaces of the disc 45, and O-rings 47 fitted around the peripheral surfaces of the filters 46 to seal the gaps between the disc 45 and the inner wall of the housing 41 and to resiliently support the disc 45. The discs 45 may be formed of porous ceramic or resin instead of a sintered porous alloy, and the orifices 43 and 44 may be pipe orifices. The throttling resistances of the orifices should be selected experimentally to function as described below.

When the engine is running a negative pressure is produced in the intake passage 1 whose magnitude varies according to the engine speed and load conditions and the position of the throttle valve 2.

Figure 3:
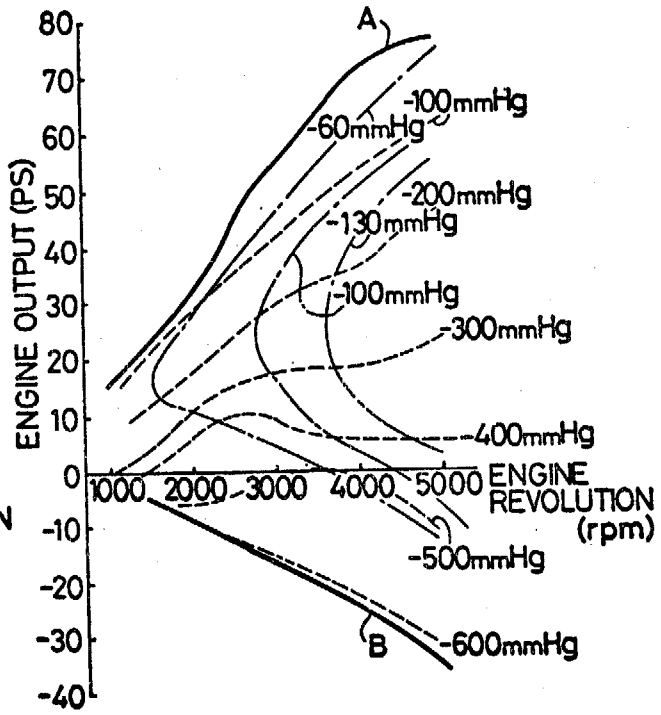
FIG. 3 is an engine output power diagram showing the negative pressure characteristics in a port 6 and the intake manifold.
Figure 2:
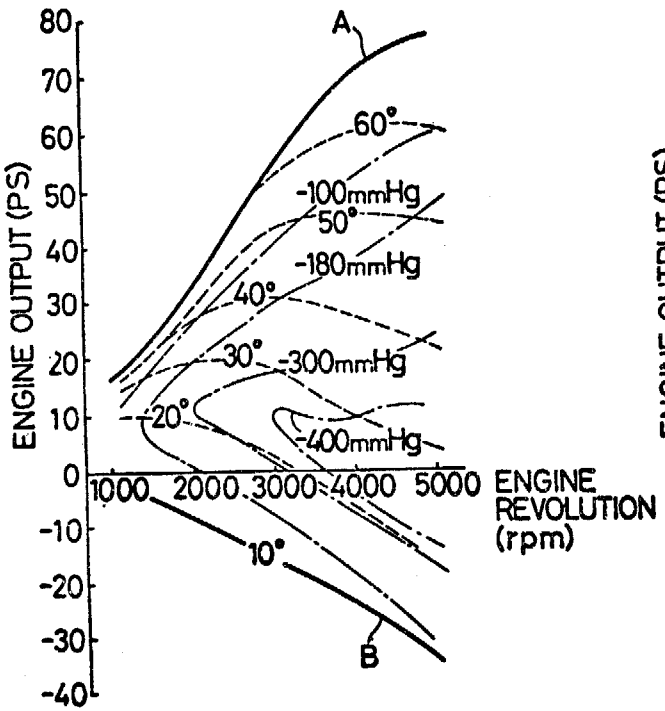
FIG. 2 is an engine output power diagram showning negative intake pressure at a port 5 and throttle opening characteristics.

In order to illustrate the general characteristics of the negative pressure produced in the ports 5 and 6 and the negative intake manifold pressure, FIGS. 2 and 3 show curves of engine output power (PS) versus engine speed (rpm). In these figures, the solid line A indicates output power under full throttle conditions and the solid line B indicates output power under idle conditions. Referring to the rotation angles of the throttle valve from the fully closed to open positions, the throttle opening under idling conditions is set at 10 degrees, the port 5 is formed in the passage wall at a position corresponding to a 13 degree throttle opening, and the port 6 is formed in the passage wall at a position corresponding to a 20 degree throttle opening.

In FIG. 2, the chain lines indicate equal negative pressure lines produced in the port 5 and the broken lines indicate equal throttle opening lines. In FIG. 3, the chain lines indicate equal negative pressure lines produced in the port 6 and the broken lines indicate equal negative pressure lines of the intake manifold.

The air chamber 42 is charged with the negative pressure produced in the port 6 through the air passage 103 and the orifice 43, and also with the negative intake manifold pressure through the air passage 104 and the orifice 44. This mixed negative pressure characteristic in the air chamber 42 varies with changes in the throttle resistances of the orifices 43 and 44. In this embodiment, the resistances of the orifices are selected to obtain the negative pressure characteristic shown in FIG. 4. In addition, the throttle resistances of the orifices are selected sufficiently large to delay the transmission of the negative pressures into the chamber 42 within a time range of from several seconds to several minutes, even when the negative pressures produced in the port 6 or the intake manifold rapidly change.

Figure 4:
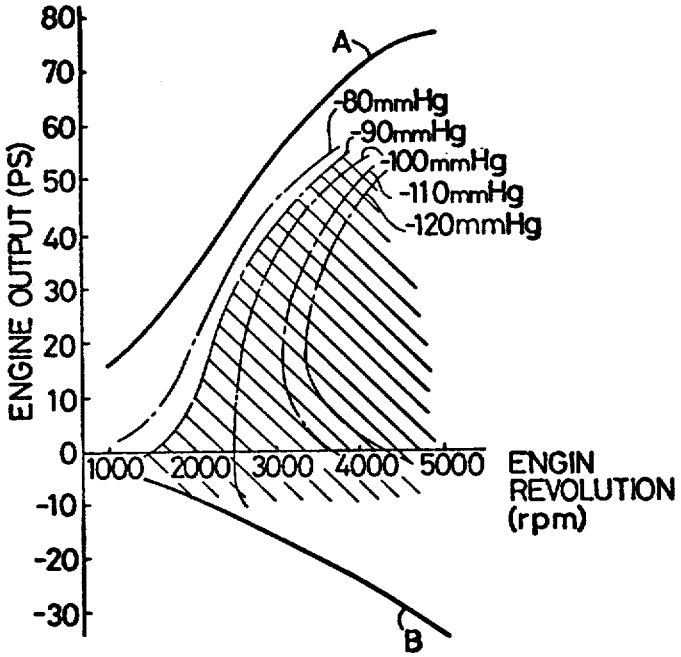
FIG. 4 is an engine output power diagram showing the negative pressure characteristics in a chamber 42 of the first embodiment.

Assuming that the force of the spring 39 is selected such that the valve 32 opens when a negative pressure of less than 90 mmHg is introduced into the chamber 37 and closes at a negative pressure of more than 90 mmHg, the pressure release opening 34 will close in the hatched area to the right of a −90 mmHg equal negative pressure line shown in FIG. 4 and will open under conditions to the left of the line. Thus, during often encountered low speed conditions the negative pressure applied to the advance diaphragm chamber 15 is reduced by the air supplied from the pressure release opening 34 to an atmospheric or low negative pressure so that the ignition timing is delayed and the production of NOX is reduced. On the other hand, during continuous high speed conditions (above about 2000 rpm), the pressure release opening 34 is closed and the pressure applied to chamber 15 is not reduced so that the ignition timing is advanced, which prevents any overheating or fire in the exhaust system and promotes increased engine output power and a reduction in fuel consumption.

During acceleration conditions which increase the NOX production, although the throttle valve 2 is opened to increase the negative pressure produced in the port 6, the communication of such pressure to the air chamber 42 is delayed by the orifice 43 and thus the ignition timing remains delayed for a certain time after the engine is accelerated so that the production of the harmful gases is minimized. This feature is particularly desirable in operation in urban areas.

In addition, since the number of openings and closings of the valve unit 30 is reduced due to the resistances of the orifices, even where the engine is frequently accelerated and decelerated, the ignition timing is not rapidly changed which minimizes any deterioration in the "drivability" of the car.

Figure 5:
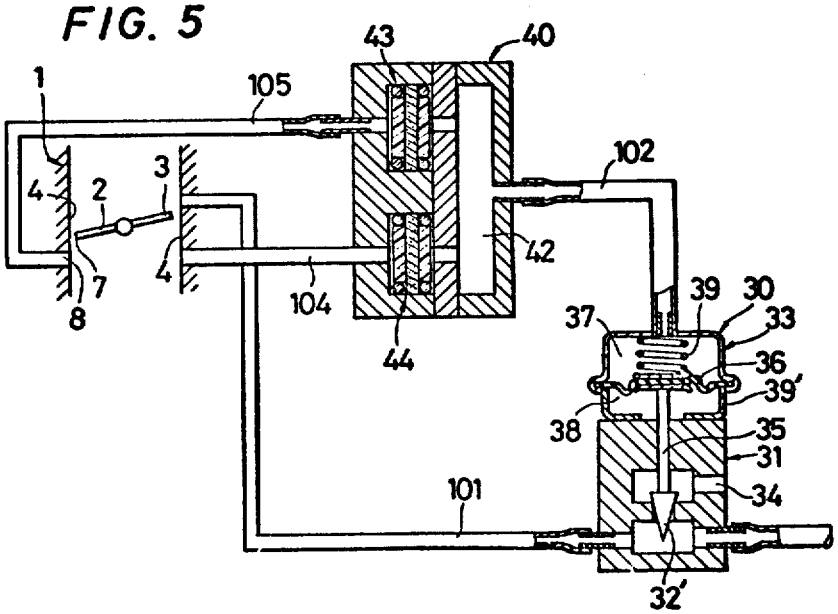
FIG. 5 is a sectional view of a second embodiment.

FIG. 5 illustrates a second embodiment of the invention in which an air passage 105 is provided instead of the air passage 103, having its one end connected to the orifice 43 and its other end connected to a port 8 formed in the passage wall at a position slightly below the fully closed position of the throttle valve in the vicinity of the downstream free end 7 thereof. In addition, a valve 32' is provided instead of the valve 32, which serves to close the pressure release opening 34 when the chamber 37 is at atmospheric or a low negative pressure (lower than 300 mmHg in this embodiment), and to open it when the chamber 37 is at a negative pressure higher than 300 mmHg. For example, assuming that the port 8 is located at a position corresponding to a 25 degree throttle opening, the negative pressure produced in the port decreases substantially in inverse proportion to the increase of the throttle opening, and goes to atmospheric pressure when the throttle opening exceeds 25 degrees.

Figure 6:
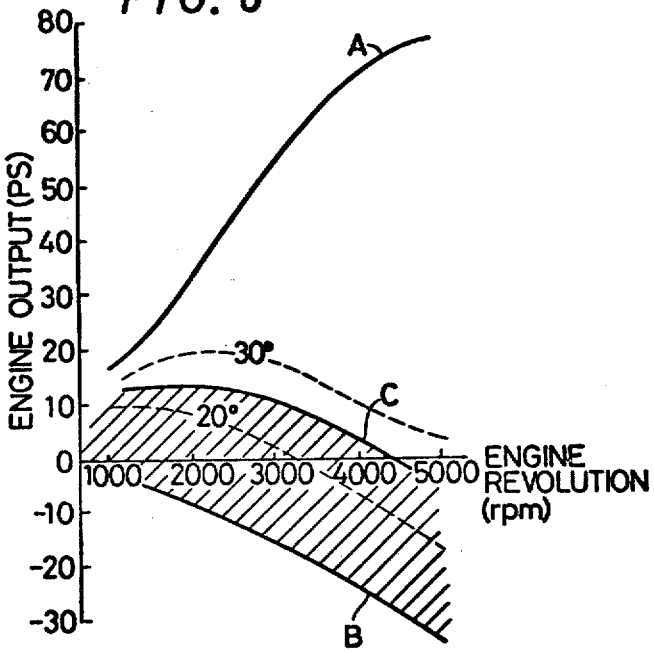
FIG. 6 is an engine output power diagram showing the operation of the pneumatic control apparatus of the second embodiment.

In this embodiment, during low engine load conditions frequently encountered in urban areas which are shown by the hatched area below tha solid line C in the power output diagram of FIG. 6, the negative pressure in chamber 42 exceeds 300 mmHg whereby the valve 32' is opened to delay or retard the ignition timing. During high load conditions above the solid line C in FIG. 6, the negative pressure in chamber 42 is less than 300 mmHg whereby the valve 32' is closed to advance the ignition timing. Thus, the ignition timing is delayed during low engine load conditions under which the throttle opening is less than a predetermined amount in order to reduce the production of harmful emissions, and during continuous high load conditions under which the throttle opening is more than the predetermined amount the ignition timing is advanced to prevent overheating, increase engine output power, and reduce fuel consumption. In addition, during acceleration wherein NOX production is increased the operation of the vacuum valve unit 30 is delayed by the orifice 43 whereby the ignition timing remains delayed for a certain time after the engine runs in a high load condition above the solid line in FIG. 6 to reduce the production of NOX. When the engine is initially started the negative intake manifold pressure supplied through the air passages 104 and 105 to the chambers 42 and 37 is delayed so that the pressure release opening 34 remains closed for a certain time after the engine is started. This advances the ignition timing to provide superior engine starting and warmup performance.

Figure 7:
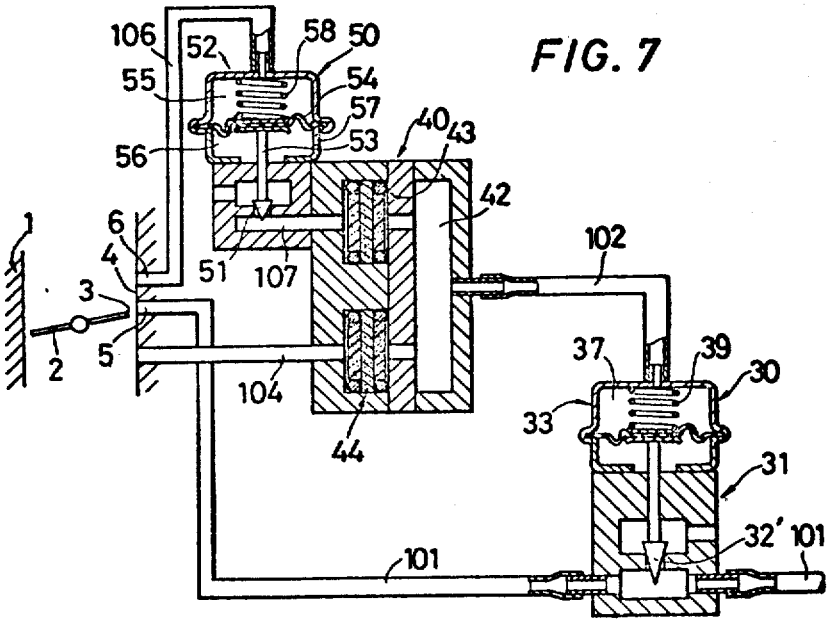
FIG. 7 is a sectional view of a third embodiment.

FIG. 7 illustrates a third embodiment of the invention wherein the air passage 105 in the second embodiment is replaced by a pressure release passage 107 for communicating the orifice 43 with the atmosphere, a valve unit 50 for controlling the opening and closing of the passage 107, and an air passage 106 for supplying negative pressure to operate the valve unit 50. The latter comprises a valve 51 for opening and closing the passage 107, and a diaphragm 54 disposed in a valve housing 52 to divide it into two chambers 55 and 56. The valve 51 is connected through a rod 53 to the center of the diaphragm 54. The chamber 55 communicates through air passage 106 with the port 6 and the chamber 56 communicates with the atmosphere through a hole 57. A spring 58 in the chamber 55 biases the diaphragm 54 in a direction to close the valve 51.

Figure 8:
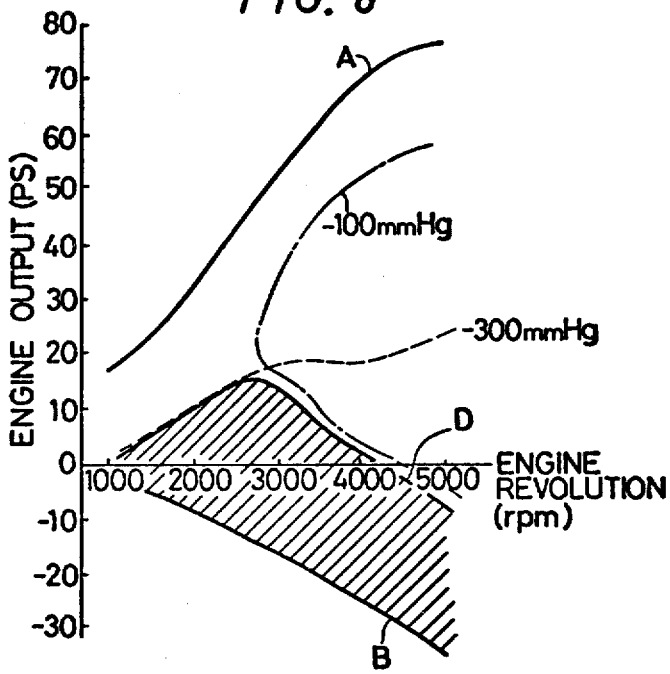
FIG. 8 is an engine output power diagram showing the operation of the apparatus of the third embodiment.

Assuming that the force of the spring member 39 is such as to change the opening and closing of the valve unit 30 at a 300 mmHg negative pressure in the chamber 37 and that the force of the spring 58 is such as to change the opening and closing of the valve unit 50 at a 90 mmHg negative pressure in the chamber 55, the negative pressures introduced into chambers 42 and 37 become equal to the negative intake manifold pressure applied through air passage 104 when the negative pressure at the port 6 is less than 90 mmHg whereat the pressure release passage 107 is closed. Conversely, the chamber pressures become equal to the sum of the negative intake manifold pressure introduced through passage 104 and the atmospheric pressure supplied the through the passage 107 when the negative pressure at the port 6 is more than 90 mmHg, whereat the passage 107 is opened. FIG. 8 shows the vacuum valve opening and closing range from the negative pressure characteristic of the intake manifold and the negative pressure produced in the port 6, as shown in FIG. 3. That is, the vacuum valve unit 30 opens in the range indicated by the hatched area between the solid lines D and B, and closes in the range between the solid lines A and D.

The broken line in FIG. 8 indicates an equal negative intake manifold pressure line of 300 mmHg, and the chain line indicates an equal negative pressure line of 100 mmHg for the port 6. The distribution of the opening and closing range of the vacuum valve unit 30 in the third embodiment can be made substantially equal to that of the valve unit 30 in the second embodiment by suitably adjusting the forces of the spring members in the respective diaphragm units.

Figure 9:
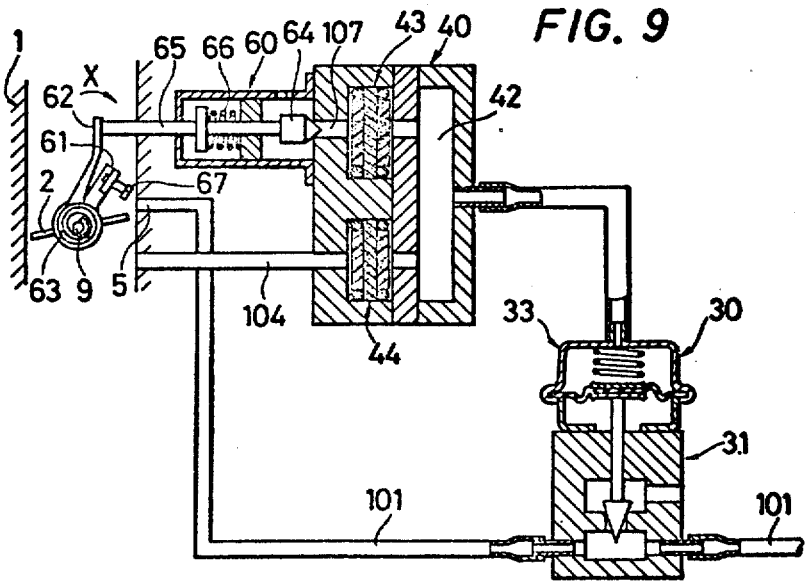
FIGS. 9 and 10 are sectional views of fourth and fifth embodiments.

FIG. 9 shows a fourth embodiment in which a control valve unit 60 mechanically detects the opening of the throttle valve 2 to thereby directly open and close the pressure release passage 107. A lever 61 is fixedly mounted on the shaft 9 of the throttle valve 2 and a lever 62 is rotatably engaged thereto and is biased in the direction of arrow X by a hair spring 63. A valve 64 opens and closes the passage 107, which is biased in the open direction by a spring 66. The end of a rod 65 fixed to the valve 64 abuts a lever 62. The tip of an adjustment screw 67 on the end of the lever 61 abuts the lever 62 when the throttle valve 2 opens a predetermined amount, and thereafter the lever 62 is rotated integrally with the further opening of the throttle valve.

During low load conditions under which the throttle valve is open less than a predetermined amount, the force of the hair spring 63 acting on the lever 62 overcomes the force of spring 66 and causes the valve 64 to close the passage 107. During high load conditions, however, whereat the throttle valve is open more than the predetermined amount, the lever 62 is rotated counterclockwise whereby the valve 64 opens the passage 107 under the force of the spring 66. Thus, the fourth embodiment functions similarly to the second embodiment.

Figure 10:
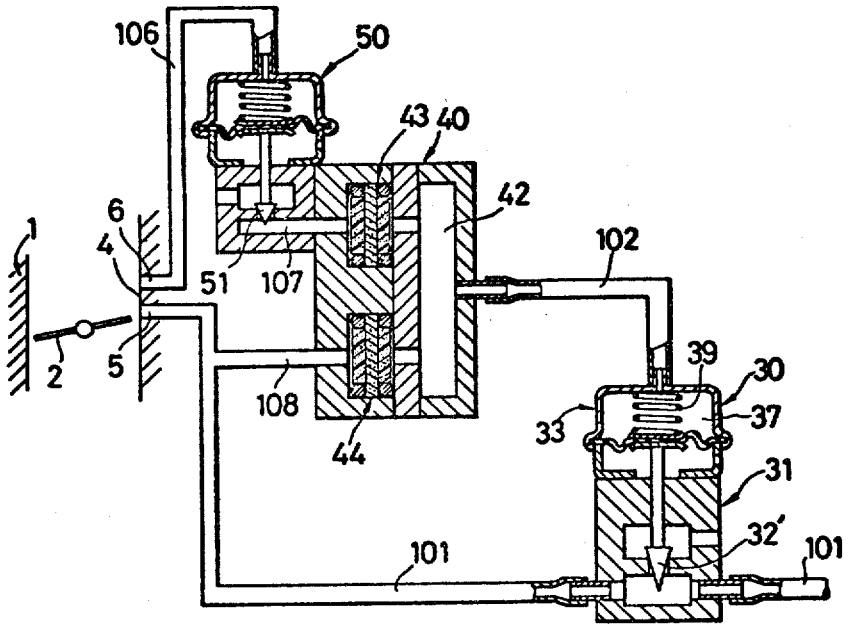
Figure 11:
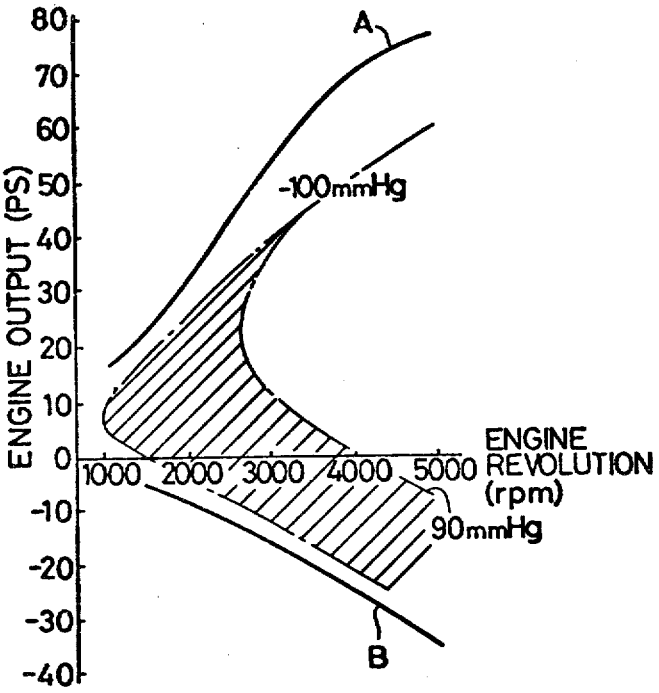
FIG. 11 is an engine output power diagram showing the operation of the fifth embodiment.

FIG. 10 illustrates a fifth embodiment wherein an air passage 108 connects the orifice 44 to the port 5. The force of the spring 39 is such that the valve 32' opens and closes at a negative pressure threshold of 100 mmHg in the chamber 37. In this embodiment the valve 32' opens in the range indicated by the hatched area in FIG. 11 and closes in the other areas. During continuous idling conditions the valve 32' closes to advance the ignition timing, which prevents exhaust system overheating.

While the above embodiments have been described in connection with the control of a distributor vacuum advance, it should be understood that these pneumatic control apparatusses are similarly applicable to the control of exhaust gas recirculation systems, dashpot control systems, and secondary air supply control systems by connecting the air passage 101 to the negative pressure chamber of a diaphragm unit associated with such systems.

Figure 12:
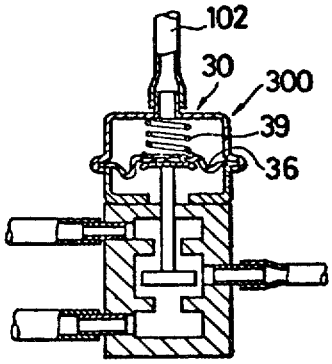
FIGS. 12 and 13 are sectional views of modified vacuum valve units.
Figure 13:
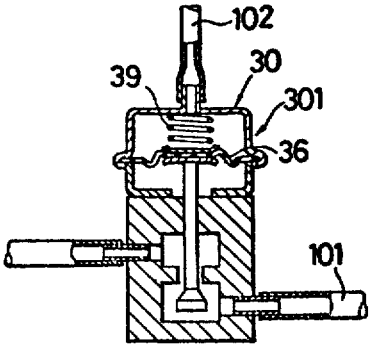

Modified operational effects can also be obtained by providing a vacuum valve unit as shown in FIGS. 12 or 13 in the passage 101 instead of the unit 30 in the above embodiments. The unit 300 shown in FIG. 12 is a change-over valve for selectively supplying the pressure of port 5 or port 6 to the advance diaphragm chamber 15 according to engine running conditions. The unit 301 shown in FIG. 13 is a valve for making and breaking the negative pressure passage 101. These valves are designed to be selectively used according to the control criteria for various kinds of exhaust gas cleaning systems.

Figure 14:
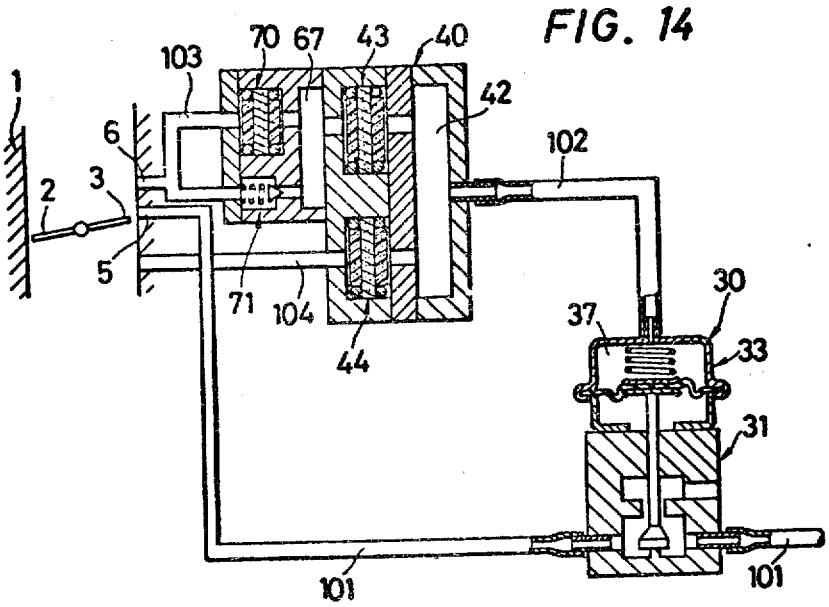
FIGS. 14 and 15 are sectional views of sixth and seventh embodiments.

FIG. 14 illustrates a sixth embodiment further comprising an orifice 70 in the air passage 103, a check valve 71 for allowing flow only in the direction from orifice 43 to port 6, and an air chamber 67. During repeated acceleration and deceleration conditions chambers 67, 42 and 37 are held at a high negative pressure whereby the ignition timing is advanced. This feature is particularly effective in traversing a mountainous road. When the check valve 71 is reversed from its orientation shown in FIG. 14 the air in chamber 67 must flow through the orifice 70 to the passage 103 when the negative pressure in port 6 rapidly increases during acceleration, and therefore any negative pressure increases in the chambers 42 and 37 are further delayed in comparison with the case where only a single orifice 43 is provided. On the other hand, when the negative pressure in port 6 rapidly decreases during deceleration, since air flows rapidly from passage 103 through check valve 71 into chamber 67, the delay of the decrease of negative presssure in chambers 42 and 37 is dependent only on the throttling effect of the orifices 43 and 44.

Accordingly, during acceleration wherein NOX production is increased, the ignition timing remains delayed until the acceleration is completed, after which the timing is advanced. On the other hand, during deceleration the timing is retarded relatively sooner to prevent it from remaining in its advanced condition during the next acceleration.

The directional orientation of the check valve 71 is determined in accordance with the type of vehicle, the intended use of the vehicle, and the type of exhaust gas cleaning apparatus to be controlled.

Figure 15:
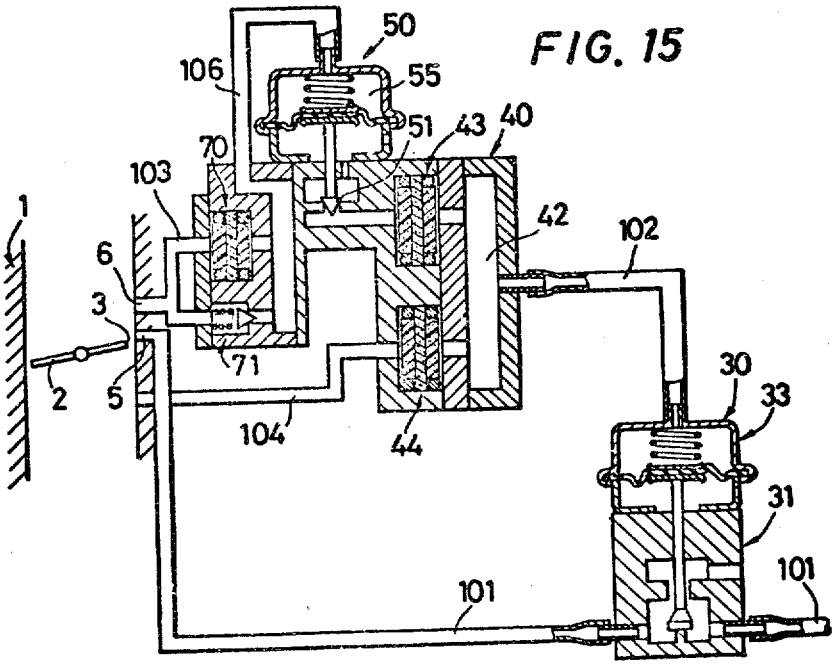

FIG. 15 illustrates a seventh embodiment in which the orifice 70 and check valve 71 of the sixth embodiment are arranged in the air passage 106 of the third embodiment, whereby the transmission of the negative pressure in port 6 to the chamber 55 of the valve unit 50 is controlled by the orifice 70 and the check valve 71 to provide an effect similar to that of the sixth embodiment.

In the descriptions and illustrations of the various embodiments of the present invention, flow restrictors have been described as sintered metal orifices. It should be understood that the sintered metal orifices are given by way of example only, and that a variety of similar flow restrictor elements could be used in place of the sintered metal orifices. Similarly, the sintered metal orifices recited in the claims hereinbelow are also given by way of example only to indicate that the flow restrictor elements referred to in the claims are intended to describe a positive structure disposed within each of the flow passages.

What is claimed is:

1. A pneumatic control apparatus for use in an internal combustion engine having an exhaust gas cleaning system, characterized by:

(a) a differential pressure responsive unit for controlling the operation of the exhaust gas cleaning system, (b) a negative pressure passage for communicating a negative pressure derived from an intake passage of the engine to a negative pressure chamber of the differential pressure responsive unit, (c) a vacuum valve disposed in the negative pressure passage for controlling the magnitude of the negative pressure communicated to said negative pressure chamber, (d) two air passages for communicating two different negative pressures derived from the engine intake passage to a negative pressure chamber of the vacuum valve, and (e) a pair of flow restrictor elements, such as sintered metal orifices individually disposed in the air passage for delaying the communication of said two different negative pressures for a predetermined time.

2. A pneumatic control apparatus for use in an internal combustion engine having an exhaust gas cleaning system, characterized by:

(a) a differential pressure responsive unit for controlling the operation of the exhaust gas cleaning system, (b) a negative pressure passage for communicating a negative pressure derived from an intake passage of the engine to a negative pressure chamber of the differential pressure responsive unit, (c) a vacuum valve disposed in the negative pressure passage for controlling the magnitude of the negative pressure communicated to said negative pressure chamber, (d) a first air passage for communicating a negative pressure whose magnitude varies in response to the operating conditions of the engine to a negative pressure chamber of the vacuum valve, (e) a second air passage for communicating an atmospheric relief opening to the negative pressure chamber of the vacuum valve, (f) a pair of flow restrictor elements, such as sintered metal orifices individually disposed in the first and second air passages for delaying the communication of air therethrough, and (g) a control valve for opening and closing the atmospheric relief opening in response to the operating conditions of the engine.

3. A pneumatic control apparatus as defined in claim 1, wherein the vacuum valve opens and closes an atmospheric pressure release opening communicating with the negative pressure passage.

4. A pneumatic control apparatus as defined in claims 1, wherein the vacuum valve opens and closes the negative pressure passage.

5. A pneumatic control apparatus as defined in claims 1, wherein the vacuum valve proportionally communicates a pair of negative pressure passages supplied with two different negative pressures produced in the engine intake system to the negative pressure chamber of the differential pressure responsive unit.

6. A pneumatic control apparatus as defined in claim 2, wherein the vacuum valve opens and closes an atmospheric pressure release opening communicating with the negative pressure passage.

7. A pneumatic control apparatus as defined in claim 2, wherein the vacuum valve opens and closes the negative pressure passage.

8. A pneumatic control apparatus as defined in claim 2, wherein the vacuum valve proportionally communicates a pair of negative pressure passages supplied with two different negative pressures produced in the engine intake stem to the negative pressure chamber of the differential pressure responsive unit.

9. A pneumatic control apparatus for use in an internal combustion engine having an exhaust gas cleaning system, characterized by:

(a) a vacuum control valve having a negative pressure chamber;

(b) a first passage for communicating a negative pressure to said negative pressure chamber from an intake passage of said engine;

(c) a second passage for communicating a second pressure different from said first pressure, to said negative pressure chamber; and (d) first and second flow restrictor elements, such as sintered metal orifices, for restricting the flow through said first and second passages to a flow rate less than that which would flow through said passages in the absence of said restrictor elements, respectively, to thereby control the magnitude of the negative pressure in the negative pressure chamber of said control valve and to provide a desired time delay to pressure changes in the intake passage.

10. A pneumatic control apparatus as defined in claim 9, wherein said second pressure is a negative pressure derived from a different position in said intake passage then said first negative pressure.

11. A pneumatic control apparatus as defined in claim 9, wherein said second pressure is an atmospheric pressure, said apparatus further comprising a control valve adapted to open and close in response to the operating conditions of the engine for controlling the introduction of atmospheric pressure to said second flow restrictor element.

12. A pneumatic control apparatus as defined in claim 10, wherein one of the negative pressures is derived from a port in an intake manifold downstream of the throttle valve, and the other negative pressure is derived from a port formed in the intake passage wall at a position slightly below the fully closed position of the throttle valve in the vicinity of the downstream side free end thereof.

13. A pneumatic control apparatus as defined in claim 10, wherein one of the negative pressures is derived from a port formed in the intake passage wall at a position slightly above the fully closed position of the throttle valve in the vicinity of the upstream side free end thereof, and the other negative pressure is derived from a port in an intake manifold downstream of the throttle valve.

14. A pneumatic control apparatus as defined in claim 11, wherein the negative intake passage pressure is derived from a port formed in the intake passage wall at a position slightly above the fully closed position of the throttle valve in the vicinity of the upstream side free end thereof.

15. A pneumatic control apparatus as defined in claim 11, wherein the further control valve is adapted to open and close in response to the magnitude of the negative pressure produced in the intake system.

16. A pneumatic control apparatus as defined in claim 11, wherein the further control valve is mechanically coupled to the throttle valve to thereby open and close according to the degree of opening of the throttle valve.

17. A pneumatic control apparatus as defined in claim 11, wherein the negative intake passage pressure is derived from a port in an intake manifold downstream of the throttle valve.

* * * * *

UNITED STATES PATENT AND TRADEMARK OFFICE

CERTIFICATE OF CORRECTION

PATENT NO. : 4,198,937

DATED : April 22, 1980

INVENTOR(S) : Motoo Suzuki

It is certified that error appears in the above—identified patent and that said Letters Patent is hereby corrected as shown below:

After the Abstract change "NO DRAWINGS" to --15 Drawing Figures--
and insert attached drawing sheets 1 thru 8 as part of the above-identified patent.

Signed and Sealed this

*Third* Day of *March 1981*

[SEAL]

*Attest:*

RENE D. TEGTMEYER

*Attesting Officer*

*Acting Commissioner of Patents and Trademarks*